US005322231A

United States Patent [19]

Greenberg et al.

[11] Patent Number: 5,322,231

[45] Date of Patent: Jun. 21, 1994

[54] MEDIA LOADER

[75] Inventors: Michael D. Greenberg, Decatur, Ga.; Donald L. Barber, Fullerton, Calif.

[73] Assignee: CalComp Inc., Anaheim, Calif.

[21] Appl. No.: 23,438

[22] Filed: Feb. 26, 1993

[51] Int. Cl.[5] ..... B65H 19/12

[52] U.S. Cl. ..... 242/58.6; 242/96; 297/145

[58] Field of Search ..... 242/58.6, 79, 68.6, 242/96; 294/1.1, 25, 15, 26, 91, 137, 145

[56] References Cited

U.S. PATENT DOCUMENTS

| | | | |
|---|---|---|---|
| 3,177,025 | 4/1965 | Short | 294/145 X |
| 4,230,286 | 10/1980 | Charles | 242/68.6 |
| 4,342,431 | 8/1982 | Watellier | 242/68.7 X |
| 4,799,721 | 1/1989 | Hale | 242/96 |
| 4,818,121 | 4/1989 | Volk | 294/137 X |
| 5,136,859 | 8/1992 | Nitta | 242/58.6 X |

*Primary Examiner*—John M. Jillions

*Attorney, Agent, or Firm*—Frederic P. Smith; William F. Porter, Jr.

[57] ABSTRACT

A media loader for a media roll having a pair of endcaps. The media loader has a handle portion, a support portion adapted to partially encircle the endcap and a flexible midportion having an opening narrower than a selected portion of the endcap and adapted to flex to allow the passage therethrough of the selected portion of the endcap. The support portion is substantially the same cross-sectional size as the selected portion of the endcap but is adapted to remain stationary when the endcap rotates therein. The handle portion is adapted to accept therethrough portions of the endcap of larger cross-sectional size than the selected portion of the endcap while the flexible midportion is sufficiently stiff so as not to flex under the weight of the media loader.

5 Claims, 1 Drawing Sheet

MEDIA LOADER

BACKGROUND OF THE INVENTION

1. Field of the Invention

This invention relates to the field of plotters and, in particular, to a media loader for a plotter which enables a wide, large diameter media roll to be easily loaded onto and unloaded from its support brackets within a plotter housing.

2. Description of Related Art

As plotters have become more sophisticated in their ability to transport media quickly for continuous multipen plots and also to run unattended for considerable periods of time, the rolls of media used in the plotting process have become wider, greater in diameter and heavier, thus making it more difficult to manually insert such rolls into the narrow confines of the plotter housing. In addition, the bulky rolls must be carefully and precisely lowered onto the support brackets within the plotter housing, which brackets are generally located very close to the side walls of the plotter housing and surrounded by numerous alignment and feed devices. While prior art devices for loading media rolls, such as the hoisting bar and hook arrangement shown in U.S. Pat. No. 4,230,286, issued Oct. 28, 1980, entitled "Core Holder for Reeling", are satisfactory for loading very large jumbo or parent rolls 5 feet in diameter and 5 to 10 axial feet in length onto exposed unwind stands, they have proven inadequate for use in inserting media rolls into the narrow confines of a commercial plotter.

Thus, it is a primary object of the present invention to provide an improved media loader for a plotter.

It is another object of the present invention to provide an improved media loader for a plotter which enables the media roll to be precisely lowered onto the support brackets within the plotter housing.

It is a further object of the present invention to provide an improved media loader for a plotter which can remain secured to the media roll within the plotter and then used to remove the core which supported the media.

It is still another object of the present invention to provide an improved media loader for a plotter which is lightweight, compact and inexpensive.

SUMMARY OF THE INVENTION

A media loader is provided for a media roll having a pair of endcaps. The media loader has a handle portion, a support portion adapted to partially encircle the endcap and a flexible midportion having an opening narrower than a selected portion of the endcap and adapted to flex to allow the passage therethrough of the selected portion of the endcap. The support portion is substantially the same cross-sectional size as the selected portion of the endcap but is adapted to remain stationary when the endcap rotates therein. The handle portion is adapted to accept therethrough portions of the endcap of larger cross-sectional size than the selected portion of the endcap while the flexible midportion is sufficiently stiff so as not to flex under the weight of the media loader.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

DESCRIPTION OF THE PREFERRED EMBODIMENT

Figure 1:
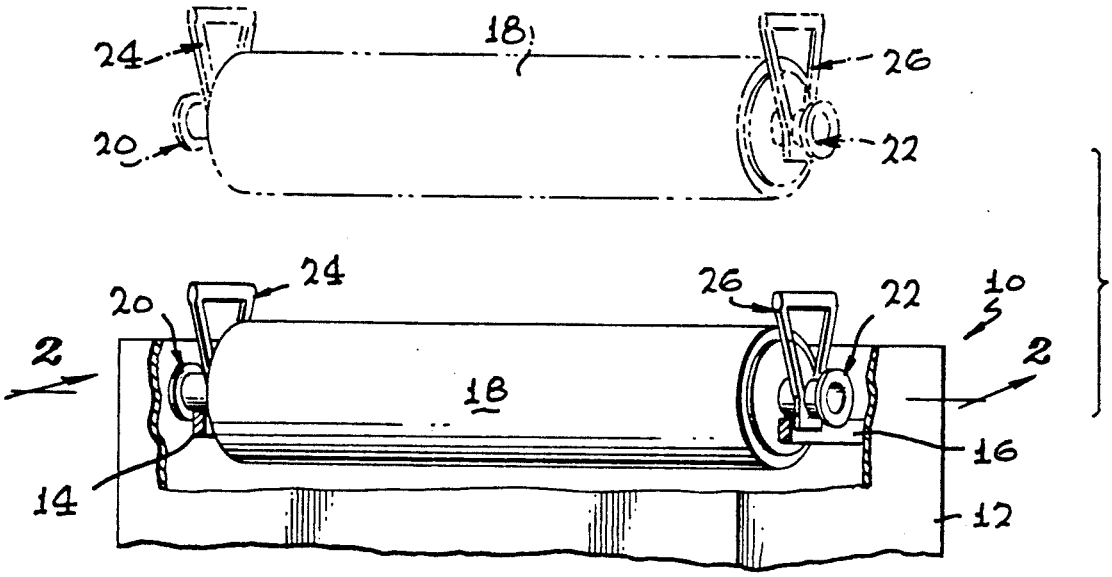
FIG. 1 is a simplified drawing of a media roll lowered into a plotter housing using the media loader of the present invention.
Figure 2:
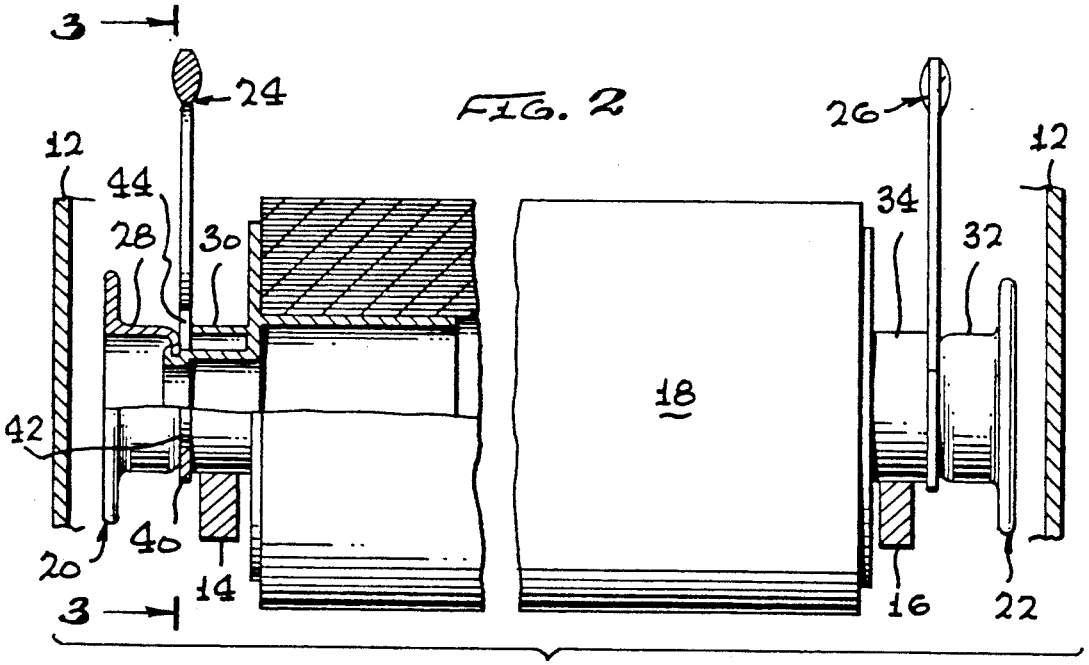
FIG. 2 is a cross-sectional view of FIG. 1 taken along line 2—2 of FIG. 1.

Referring now to FIG. 1, a plotter 10 is shown having a housing 12 and a pair of support brackets 14,16 positioned therein to support media roll 18. Endcaps 20,22 extend from the core of the media roll 18 and media loaders 24,26 rest on endcaps 20,22, respectively, within the housing 12. The media roll 18, the endcaps 20,22 and the media loaders 24,26 are also shown in phantom above the plotter housing 12, with the media loaders 24,26 supporting the endcaps 20,22 to lower the media roll 18 into position inside the housing 12. As is shown in FIG. 1, the media loaders 24,26 are thin enough to fit between the walls of the housing 12 and the ends of the media roll 18 and still allow room for the endcaps 20,22 to rest on the support brackets 14,16. As is shown in cross-section in FIG. 2, the endcaps 20,22 also have flanges 28,30,32,34 which entrap the media loaders 24,26 therebetween.

Figure 3:
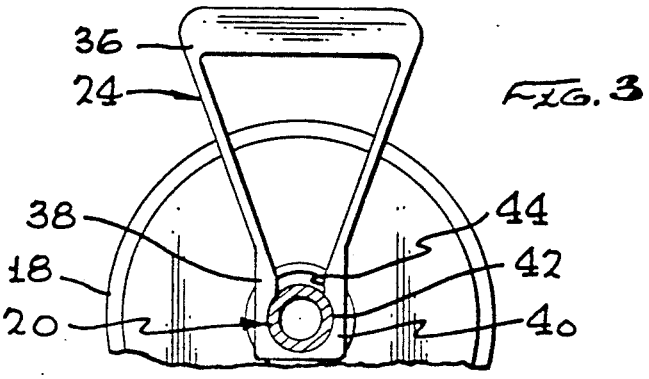
FIG. 3 is a cross-sectional view of FIG. 1 taken along line 3—3 of FIG. 1.

The media loader 24 is illustrated in cross-section in FIG. 3. The media loader 24 comprises a handle portion 36, a midportion 38 and a support portion 40. The support portion 40 of the media loader 24 partially encircles the endcap 20 at a portion 42 of the endcap 20 between the flanges 28,30 and is substantially the same cross-sectional size as portion 42 but is made slightly larger or with a very low coefficient of friction so as to remain stationary when the media roll 18 and thus endcap 20 rotates therein. The middle portion 38 of the media loader 24 has an opening 44 narrower than portion 42 of the endcap 20 but is made of a material, such as teflon, which can flex sufficiently to allow the passage therethrough of portion 42 of endcap 20, but is sufficiently stiff so as not to flex under the weight of media loader 24 so as to prevent the media loaders from dropping down and the endcaps reentering the handle portions when the endcaps are lowered onto the support brackets and the media loaders released. The handle portion 36, as contrasted with the support portion 40, is made large enough to accept therethrough the entire endcap 20, including flanges 28,30.

In normal usage then, the handle portion 36 of media loader 24 is slipped over the endcap 20 until the portion 42 of endcap 20 is reached, whereupon portion 42 is forced through the opening 44 of the flexible midportion 38 into the support portion 40 of media loader 24. The same procedure is then followed with media loader 26 and endcap 22. When the media loaders 24,26 are secured onto endcaps 20,22, the media roll 18 is then lifted above the housing 12 of the plotter 10 and lowered into position onto support brackets 14,16. The housing 12 can then be closed with the media loaders 24,26 remaining in place and the plotter 10 operated with the media roll 18 and the endcaps 20,22 turning while the media loaders 24,26 remain stationary. When the media roll 18 is spent, its core can then be lifted out of the housing 12 by the media loaders 24,26 and the media loaders 24,26 disengaged from the media roller 18 and placed onto a new media roll.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

We claim:

1. A media loader for a media roll having a pair of endcaps comprising:

a handle portion;

a support portion for partially encircling a flexible midportion having an opening narrower than a selected portion of said endcap which flexes to allow the passage therethrough of said selected portion of said endcap and to allow said media loader to be easily engaged and disengaged from said media roll.

2. The media loader of claim 1 wherein said support portion has substantially the same cross-sectional size as said selected portion of said endcap.

3. The media loader of claim 1 wherein said flexible midportion is sufficiently stiff so as to not flex under the weight of said media loader.

4. The media loader of claim 1 wherein said selected portion of said endcap is abutted by regions of larger cross-sectional size.

5. The media loader of claim 1 wherein said handle portion is adapted to accept therethrough portions of said endcap of larger cross-sectional size than said selected portion of said endcap.

* * * * *